US009360827B2

(12) United States Patent
Nakajima

(10) Patent No.: US 9,360,827 B2
(45) Date of Patent: Jun. 7, 2016

(54) IMAGE FORMING APPARATUS INCLUDING A CLEANING UNIT CONFIGURED TO CLEAN A PART OF A CONTAINER

(71) Applicant: CANON KABUSHIKI KAISHA, Tokyo (JP)

(72) Inventor: Takao Nakajima, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/616,880

(22) Filed: Feb. 9, 2015

(65) Prior Publication Data

US 2015/0248102 A1 Sep. 3, 2015

(30) Foreign Application Priority Data

Feb. 28, 2014 (JP) ..... 2014-038533

(51) Int. Cl.
*G03G 15/08* (2006.01)
*G03G 21/10* (2006.01)
*G03G 21/00* (2006.01)

(52) U.S. Cl.
CPC ..... *G03G 21/10* (2013.01); *G03G 15/0879* (2013.01); *G03G 21/00* (2013.01); *G03G 15/0886* (2013.01)

(58) Field of Classification Search
CPC ..... G03G 15/0867; G03G 15/0877; G03G 15/0879
USPC ..... 399/98, 99, 258, 260
See application file for complete search history.

(56) References Cited

U.S. PATENT DOCUMENTS 7,006,779 B2 * 2/2006 Otani ..... G03G 15/0856 399/258
7,450,890 B2 * 11/2008 Murakami et al. . G03G 15/0868 399/258
8,630,559 B2 * 1/2014 Hasebe ..... G03G 15/0879 399/258

(Continued)

FOREIGN PATENT DOCUMENTS

EP 1 211 570 A2 6/2002
EP 2 720 088 A2 4/2014

(Continued)

OTHER PUBLICATIONS

European Search Report dated Jun. 29, 2015, in related European Patent Application No. 15155311.2.

*Primary Examiner* — William J Royer
(74) *Attorney, Agent, or Firm* — Fitzpatrick, Cella, Harper & Scinto

(57) ABSTRACT

An image forming apparatus includes an apparatus main body, a container which is removably mountable to the apparatus main body and has an outlet configured to discharge developer contained in the container, and a connecting route member having an opening portion configured to be separated from and connected to the outlet and a route through which the developer supplied to the opening portion passes. In addition, moving unit moves the connecting route member in a direction in which the opening portion is moved toward the outlet when the container is mounted to the apparatus main body, and in a direction in which the opening portion is moved away from the outlet when the container is removed from the apparatus main body. A cleaning unit cleans a part of the container, which faces the opening portion, after connection between the outlet and the opening portion is released.

8 Claims, 9 Drawing Sheets

(56) References Cited

U.S. PATENT DOCUMENTS

| | | | | |
|---|---|---|---|---|
| 8,918,030 | B2 * | 12/2014 | Kimura et al. ..... | G03G 15/0872 399/258 |
| 9,031,473 | B2 * | 5/2015 | Kitagawa ..... | G03G 15/0865 399/258 |
| 2004/0265010 | A1 | 12/2004 | Otani | |
| 2014/0153974 | A1 | 6/2014 | Jimba et al. | |
| 2014/0169835 | A1 | 6/2014 | Nakajima | |
| 2015/0010334 | A1 | 1/2015 | Nakajima | |

FOREIGN PATENT DOCUMENTS

| | | | |
|---|---|---|---|
| JP | H08-015970 | A | 1/1996 |
| JP | 2013-011782 | A | 1/2013 |
| JP | 2013-015826 | A | 1/2013 |
| JP | 2014-021246 | A | 2/2014 |
| WO | 2011/155642 | A1 | 12/2011 |

* cited by examiner

IMAGE FORMING APPARATUS INCLUDING A CLEANING UNIT CONFIGURED TO CLEAN A PART OF A CONTAINER

BACKGROUND OF THE INVENTION

1. Field of the Invention

The present invention relates to an image forming apparatus such as a copying machine, a printer, a facsimile machine, and a multifunction peripheral having a plurality of functions of those machines. More particularly, the present invention relates to a configuration in which a container containing developer is removably mountable to an apparatus main body.

2. Description of the Related Art

Hitherto, in an image forming apparatus employing, for example, an electrophotographic system, there has been known a configuration in which a container containing developer is mounted to an apparatus main body, and the developer is supplied from the container to a developing device through a supply device. For example, there has been proposed a container in which a pump portion of the container is expanded and compressed so as to change a pressure therein to discharge developer into the supply device (Japanese Patent Application Laid-Open No. 2013-15826).

However, in the configuration including such a container, when the container is removed from the apparatus main body for the purpose of replacement, the developer may leak from a connecting portion connecting the container and the supply device. As a result, a part of the container may be fouled. For example, in the invention disclosed in Japanese Patent Application Laid-Open No. 2013-15826, when the container is removed from the apparatus main body, the connecting portion is retracted from an outlet of the container. However, in this case, the pressure in a route through which the developer in the supply device passes may become higher to cause the developer in the route to spill out. The developer that spills out in this way adheres to the container. When the developer adheres to the container, a user may touch the developer at the time of removing the container from the apparatus main body.

SUMMARY OF THE INVENTION

In view of such circumstances, the present invention provides an image forming apparatus which reduces a situation where a user touches developer adhering to a container at the time when the container is removed from an apparatus main body.

According to one embodiment of the present invention, there is provided an image forming apparatus, comprising: an apparatus main body; a container which is removably mountable to the apparatus main body and has an outlet configured to discharge developer contained in the container; a connecting route member having an opening portion configured to be separated from and connected to the outlet, and a route through which the developer supplied to the opening portion passes; a moving unit configured to move the connecting route member in a direction in which the opening portion is moved toward the outlet at a time when the container is mounted to the apparatus main body, and in a direction in which the opening portion is moved away from the outlet at a time when the container is removed from the apparatus main body; and a cleaning unit configured to clean a part of the container, which faces the opening portion, after connection between the outlet and the opening portion is released.

Further features of the present invention will become apparent from the following description of exemplary embodiments with reference to the attached drawings.

DESCRIPTION OF THE EMBODIMENTS

Figure 1:
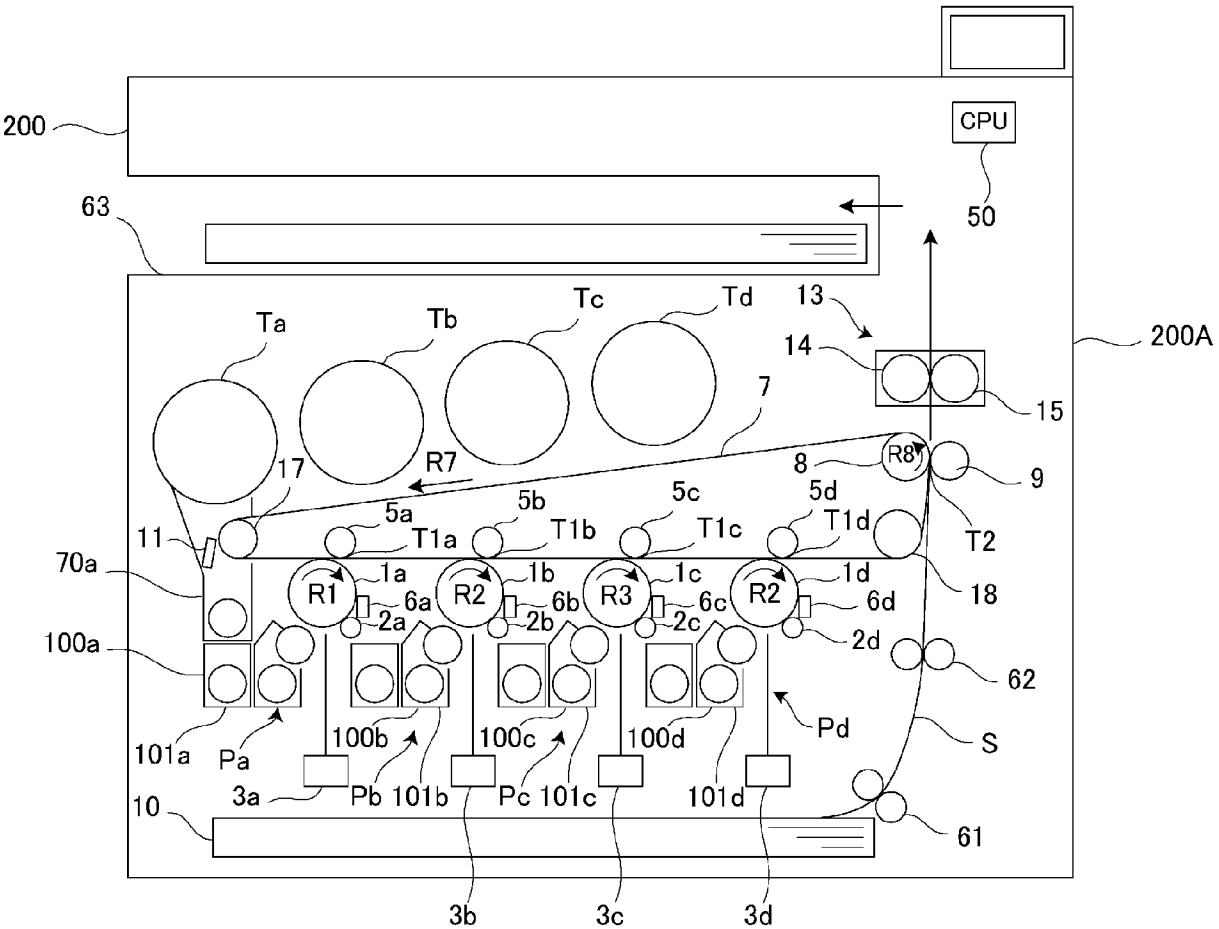
FIG. 1 is a schematic configuration diagram of an image forming apparatus according to an embodiment of the present invention.

An embodiment of the present invention will be described with reference to the accompanying drawings. First, a schematic configuration of an image forming apparatus according to the embodiment will be described with reference to FIG. 1.

[Image Forming Apparatus]

An image forming apparatus 200 according to the embodiment is an electrophotographic color image forming apparatus, specifically, an image forming apparatus of what is called an intermediate transfer tandem type in which four color image forming portions are arrayed above an intermediate transfer belt 7. The intermediate transfer tandem type is excellent in productivity and adaptable to conveyance of various media, and hence has become mainstream in recent years. Note that, a direction perpendicular to the drawing sheet of FIG. 1 corresponds to a near-and-far direction of the image forming apparatus 200.

First, a conveying process of recording materials S in the image forming apparatus 200 will be described. Here, examples of the recording materials S include a sheet material such as a paper sheet and an OHP (overhead projector) sheet. The recording materials S are contained in a manner of being stacked in a storage 10, and are fed by a feed roller 61 employing a friction separation system in synchronization with image formation. The recording material S fed out by the feed roller 61 is conveyed to a registration roller 62 through a conveying path. After skew feed correction and timing correction by the registration roller 62, the recording material S is sent to a secondary transfer portion T2. The secondary transfer portion T2 is a transfer nip portion formed of an inner secondary transfer roller 8 and an outer secondary transfer roller 9 facing each other. The secondary transfer portion T2 applies a predetermined pressure force and a predetermined electrostatic load bias so as to attract toner images onto the recording materials S.

Next, a process of forming images to be conveyed to the secondary transfer portion T2 at the same timing with the recording material S which is conveyed as described above by the conveying process until the secondary transfer portion T2 will be described. Image forming portions Pa, Pb, Pc, and Pd mainly and respectively include photosensitive drums 1*a*, 1*b*, 1*c*, and 1*d*, charging devices 2*a*, 2*b*, 2*c*, and 2*d*, exposure devices 3*a*, 3*b*, 3*c*, and 3*d*, developing devices 100*a*, 100*b*, 100*c*, and 100*d*, developing containers 101*a*, 101*b*, 101*c*, and 101*d*, primary transfer rollers 5*a*, 5*b*, 5*c*, and 5*d*, and drum cleaners 6*a*, 6*b*, 6*c*, and 6*d*.

Photosensitive drums 1*a* to 1*d* as image bearing members are driven to rotate so that surfaces thereof are uniformly charged in advance respectively by the charging devices 2*a* to 2*d*. Then, on the charged surfaces of the photosensitive drums 1*a* to 1*d* (image bearing members), electrostatic latent images are formed by the exposure devices 3*a* to 3*d* which are driven based on signals of image information, respectively.

Next, the electrostatic latent images formed respectively on the photosensitive drums 1*a* to 1*d* are developed into toner images by the developing devices 100*a* to 100*d* each containing developer including toner. Then, in primary transfer portions T1*a*, T1*b*, T1*c*, and T1*d*, a predetermined pressure force and a predetermined electrostatic load bias are applied by the primary transfer rollers 5*a* to 5*d*. With this, the toner images are transferred respectively from the photosensitive drums 1*a* to 1*d* in a superimposed manner onto the intermediate transfer belt 7. Lastly, untransferred residual toner slightly remaining on the photosensitive drums 1*a* to 1*d* is collected by the drum cleaners 6*a* to 6*d*, to thereby prepare for subsequent image forming processes.

The intermediate transfer belt 7 will be described. The intermediate transfer belt 7 is installed to an intermediate transfer belt frame (not shown), and passed over a tension roller 17, an upstream secondary transfer roller 18, and the inner secondary transfer roller serving as a drive transmission unit configured to transmit the drive to the intermediate transfer belt 7. When the inner secondary transfer roller 8 is driven in a direction indicated by an arrow R8, the intermediate transfer belt 7 is driven in a direction indicated by an arrow R7. The intermediate transfer belt 7 is an endless belt.

The image forming portions Pa to Pd described above respectively form toner images of yellow (Y), magenta (M), cyan (C), and black (Bk). Note that, the number of colors is not limited to the stated number of four colors or the stated order. Further, the developing containers 101*a* to 101*d* of the developing devices 100*a* to 100*d* contain in advance two-component developer obtained by mixing non-magnetic toner and magnetic carrier together. Note that, a single-component developer containing only one of magnetic toner and non-magnetic toner may be used. In the embodiment, the two-component developer containing non-magnetic toner and magnetic carrier is used as the developer.

The image forming processes of the colors of Y, M, C, and Bk are executed parallel to each other respectively by the image forming portions Pa to Pd of the respective colors at such timings that the toner images are sequentially superimposed on preceding toner images of upstream colors, which are subjected to primary transfer onto the intermediate transfer belt 7. As a result, a full-color toner image is formed on the intermediate transfer belt 7, and finally conveyed to the secondary transfer portion T2. Note that, untransferred residual toner remaining even after passage through the secondary transfer portion T2 is collected by a transfer cleaning device 11.

By the conveying process and the image forming processes described above, the full-color toner images and the recording material S reach the secondary transfer portion T2 at the same time. Then, secondary transfer is performed. After that, the recording material S is conveyed into a fixing device 13. In the fixing device 13, a fixing nip formed by opposed rollers 14, 15 applies predetermined heat and pressure to the recording material S passing through the fixing nip. With this, the toner images are fused and fixed to the recording material S.

Thus, the fixing device 13 includes a heater as a heat source, and is controlled to constantly maintain an optimum temperature. After the images are fixed as described above, route selection as to whether the recording material S is delivered onto a delivery tray 63 or conveyed to a reverse conveying device (not shown) in a case where duplex image formation is needed is performed.

In the embodiment, when amounts of toners in the developing devices 100*a* to 100*d* decrease through the image forming processes as described above, toners are supplied from corresponding containers Ta, Tb, Tc, and Td respectively to supply devices 70*a*, 70*b*, 70*c*, and 70*d* (70*b*, 70*c*, and 70*d* are not shown in FIG. 1). Then, the supply devices 70*a* to 70*d* supply toners respectively to the developing devices 100*a* to 100*d* by being driven in synchronization with the corresponding developing devices 100*a* to 100*d*. The supply operation will be described later.

[Container T]

Figure 2:
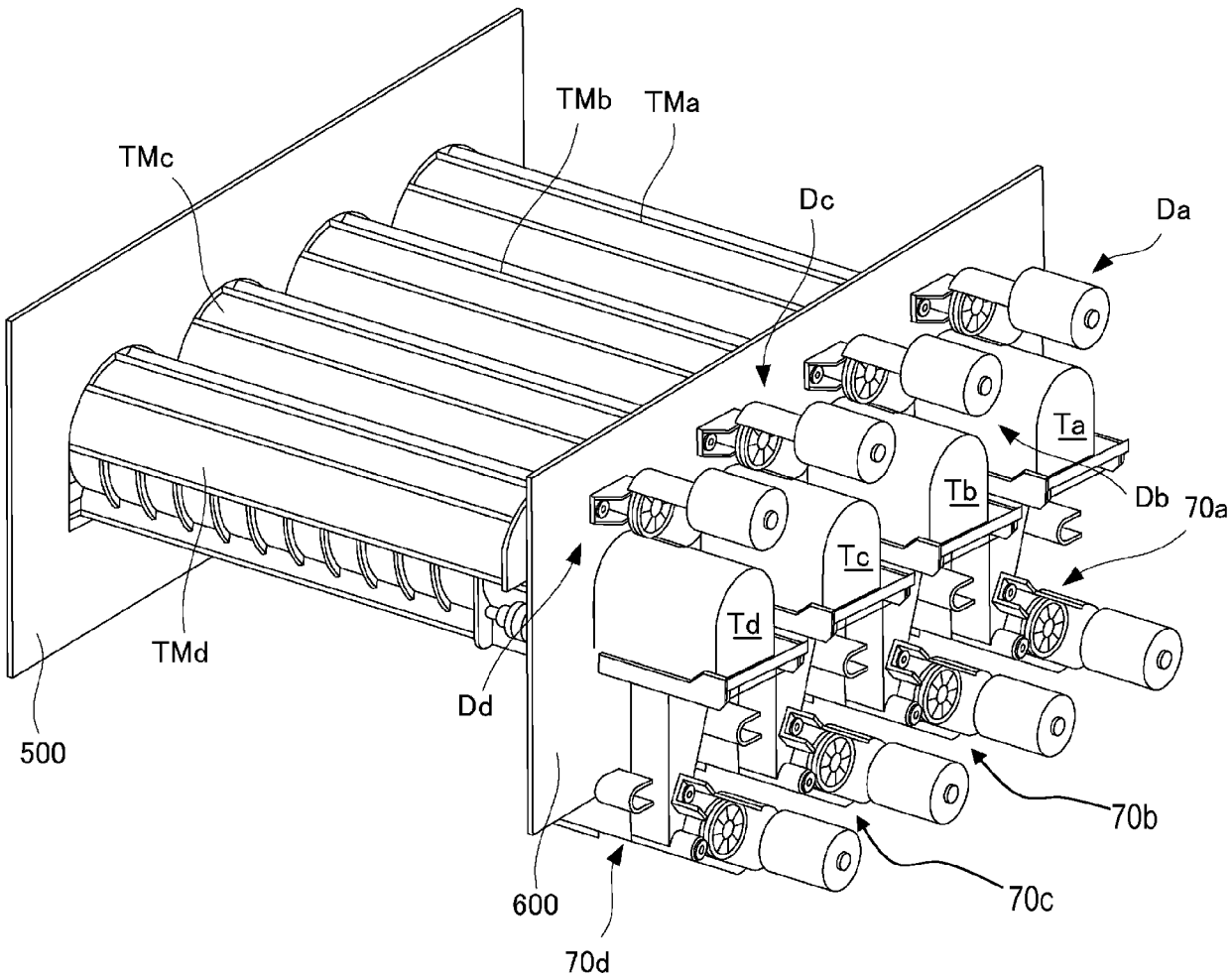
FIG. 2 is a perspective view of a configuration configured to supply developer according to the embodiment.

Next, as illustrated in FIG. 2, the containers Ta to Td (FIG. 1) are received and held respectively by holding members TMa, TMb, TMc, and TMd bridging a front plate 500 and a rear plate 600 which are fixed to an apparatus main body 200A (FIG. 1). The holding members TMa to TMd independently bridge the front plate 500 and the rear plate 600. The containers Ta to Td are held in a manner of being mountable to the holding members TMa to TMd and removable from the holding members TMa to TMd. In other words, the containers Ta to Td are removably mountable to the apparatus main body 200A. Further, devices configured to respectively drive the developing devices 100*a* to 100*d*, and the containers Ta to Td and the supply devices 70*a* to 70*d* which will be described later, are fastened and installed to the rear plate 600. Note that, the containers Ta to Td, the supply devices 70*a* to 70*d*, and the holding members TMa to TMd respectively have the same configuration, and hence suffixes are omitted in the description herein below unless otherwise deemed necessary.

Figure 3A:
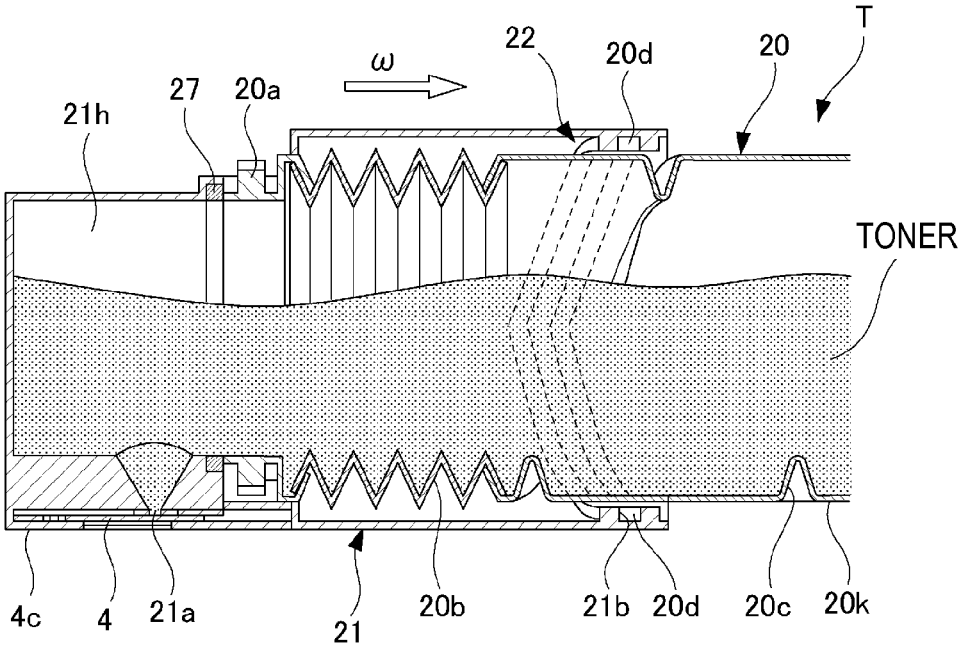
FIGS. 3A and 3B are sectional views of a part of a container according to the embodiment, for illustrating an operation of supplying developer from the container.

As illustrated in FIG. 3A, the container T configured to contain toner includes a toner containing portion 20 which is formed into a hollow cylindrical shape and has an interior space for containing the toner. Further, the container T includes a flange portion 21 (also referred to as an non-rotating portion) formed on one end side in a longitudinal direction of the toner containing portion 20 (developer conveying direction). Further, the toner containing portion 20 is configured to be rotated relative to the flange portion 21.

Figure 3B:
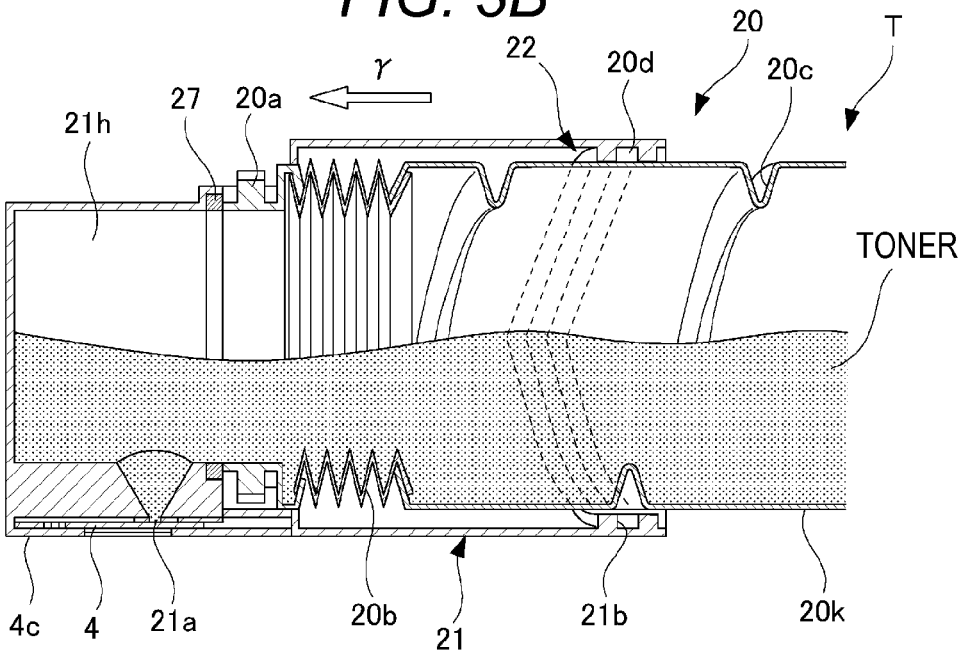

As illustrated in FIG. 3B, the flange portion 21 includes a hollow discharge portion 21*h* configured to temporarily pool the toner conveyed from an inside of the toner containing portion 20. Through a bottom portion of the discharge portion 21*h*, there is formed a small discharge port 21*a* configured to allow the toner to be discharged to an outside of the container T, in other words, to supply the toner to the supply device 70*a* (refer to FIG. 1). Further, in an inside of the flange portion 21, there is provided a shutter (shutter member) 4 configured to open and close the discharge port 21*a*. The shutter 4 seals the discharge port 21*a* formed in the container T. Movement of the shutter 4 will be described later.

Further, the container T includes a pump portion 20*b* configured to perform a toner discharging operation. The pump portion 20*b* functions as an air intake and exhaust mechanism configured to alternately perform an air intake operation and an air exhaust operation through the discharge port 21*a*. As illustrated in FIG. 3B, the pump portion 20*b* is interposed between the discharge portion 21*h* and a cylindrical portion 20*k* of the toner containing portion 20, and is connected and fixed to the cylindrical portion 20*k*. In other words, the pump portion 20*b* is configured to be rotated integrally with the cylindrical portion 20*k*. Further, the pump portion 20*b* is configured to contain toner.

Further, in the embodiment, a resin capacity-variable pump (bellows pump) which is variable in capacity along with reciprocation (the arrow ω and the arrow γ indicate moving directions of the pump portion 20*b*) is employed as the pump portion 20*b*. Specifically, as illustrated in FIGS. 3A and 3B, the employed bellows pump includes a plurality of "mountain fold" portions and a plurality of "valley fold" portions which are regularly and alternately formed.

Further, as illustrated in FIG. 3B, the pump portion 20*b* is attached to be rotatable with respect to the discharge portion 21*h* in a state in which a ring-shaped sealing member 27 provided along an inner surface of the flange portion 21 is compressed by an end portion on the side of the discharge portion 21*h* of the pump portion 20*b*.

The container T includes a gear portion 20*a*. The gear portion 20*a* is fixed to one end in a longitudinal direction of the pump portion 20*b*. In other words, the gear portion 20*a*, the pump portion 20*b*, and the cylindrical portion 20*k* are configured to be rotated integrally with one another. With this configuration, a rotational driving force input to the gear portion 20*a* is transmitted to the cylindrical portion 20*k* (conveying portion 20*c*) through intermediation of the pump portion 20*b*.

Figure 4:
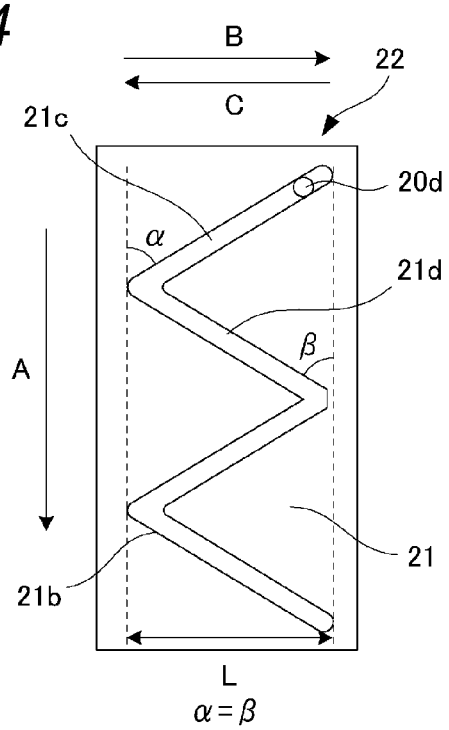
FIG. 4 is a development view of a groove portion of a cam mechanism configured to drive a pump portion of the container according to the embodiment.

Meanwhile, a cam mechanism 22 comprising a cam projection 20*d* and a groove portion 21*b* is interposed between the flange portion 21 and the toner containing portion 20 so that the pump portion 20*b* is driven. Specifically, the cam projection 20*d* is formed on an outer peripheral surface of the cylindrical portion 20*k* of the toner containing portion 20, and the groove portion 21*b* which functions as a driven portion into which the cam projection 20*d* is fitted is formed over the entire inner peripheral surface of the flange portion 21. This groove portion 21*b* will be described with reference to FIG. 4. In FIG. 4, an arrow A indicates a rotation direction of the cylindrical portion 20*k* (moving direction of the cam projection 20*d*), an arrow B indicates an expansion direction of the pump portion 20*b*, and an arrow C indicates a compression direction of the pump portion 20*b*.

Further, an angle α is formed between the rotation direction A of the cylindrical portion 20*k* and a groove part 21*c*, and an angle β is formed between the rotation direction A and a groove part 21*d*. Still further, the groove portion 21*b* has an amplitude (expansion and compression length of the pump portion 20*b*) L in the expansion and compression directions B and C of the pump portion 20*b*. Note that, the groove parts 21*c* and 21*d* are components of the groove portion 21*b*. Specifically, in the groove portion 21*b*, the groove parts 21*c* each inclined from the side of the cylindrical portion 20*k* to the side of the discharge portion 21*h* and the groove parts 21*d* each inclined from the side of the discharge portion 21*h* to the side of the cylindrical portion 20*k* are coupled alternately to each other. In the embodiment, α=β is established.

Thus, in the embodiment, the cam projection 20*d* and the groove portion 21*b* function as a drive transmission mechanism configured to transmit a drive force to the pump portion 20*b*. In other words, the cam projection 20*d* and the groove portion 21*b* function as a mechanism configured to convert the rotational driving force received by the gear portion 20*a* to a force of directions in which the pump portion 20*b* is reciprocated (a force of a rotation axis direction of the cylindrical portion 20*k*), and transmit the force to the pump portion 20*b*.

[Toner Discharging Operation in Container]

Next, an operation of discharging toner from the container T will be described with reference to FIG. 2, FIG. 5, and FIG. 6. As illustrated in FIG. 2, driving devices Da, Db, Dc, and Dd configured to respectively drive the containers T are installed to the rear plate 600. Note that, the driving devices Da to Dd have the same configuration, and hence suffixes are omitted in the description hereinbelow. The driving device D includes a motor 80 (bottle drive motor), and a gear 41, a gear 42, and a gear member 43 configured to reduce and transmit a driving force by the motor 80. The gear 41 is mounted to the shaft of the motor 80, and rotation of the gear 41 is transmitted to the gear member 43 through intermediation of the gear 42. The gear member 43 is meshed with the gear portion 20*a* provided on an outer periphery of the container T. With this, the driving force by the motor 80 is transmitted to the gear 41, the gear 42, the gear member 43, and the gear portion 20*a* so that the gear portion 20*a* is driven to rotate the cylindrical portion 20*k* of the container T. With this, as described above, the pump portion 20*b* reciprocates to discharge the toner from the container T.

Figure 6:
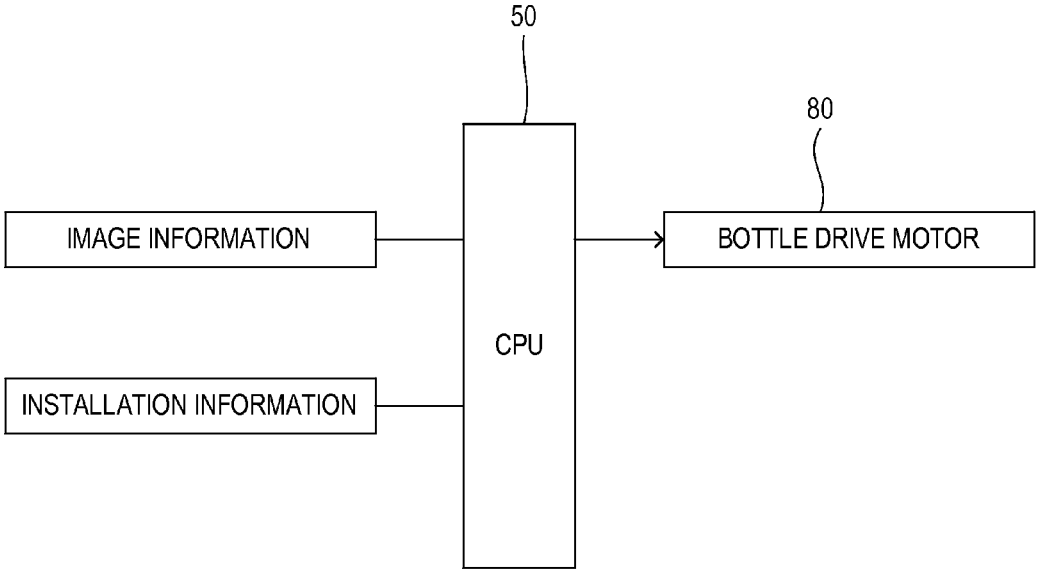
FIG. 6 is a control block diagram illustrating a configuration configured to supply the developer from the container according to the embodiment.

FIG. 6 is a block diagram illustrating how a CPU 50 as a control portion of the image forming apparatus 200 performs control. As illustrated in FIG. 6, when receiving image information of the recording material S to be output and installation information of the container T, the CPU 50 sends a rotation timing and a rotation time period of the motor 80. With this, a predetermined amount of toner is stably supplied from the container T into the supply device 70.

Figure 5:
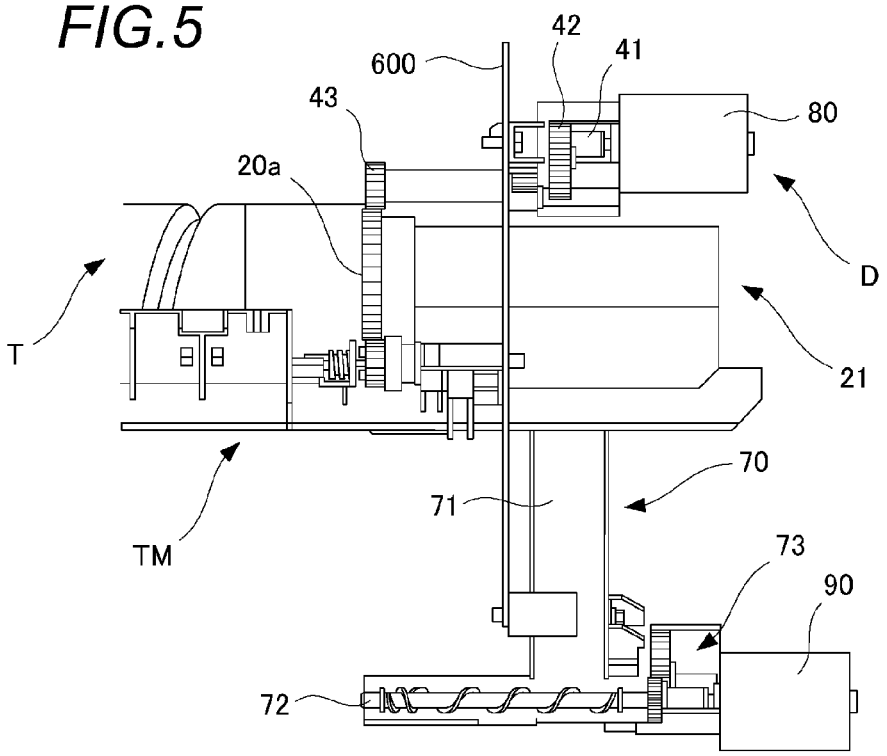
FIG. 5 is a partially cutaway side view of a part of a developer supply section according to the embodiment.
Figure 7:
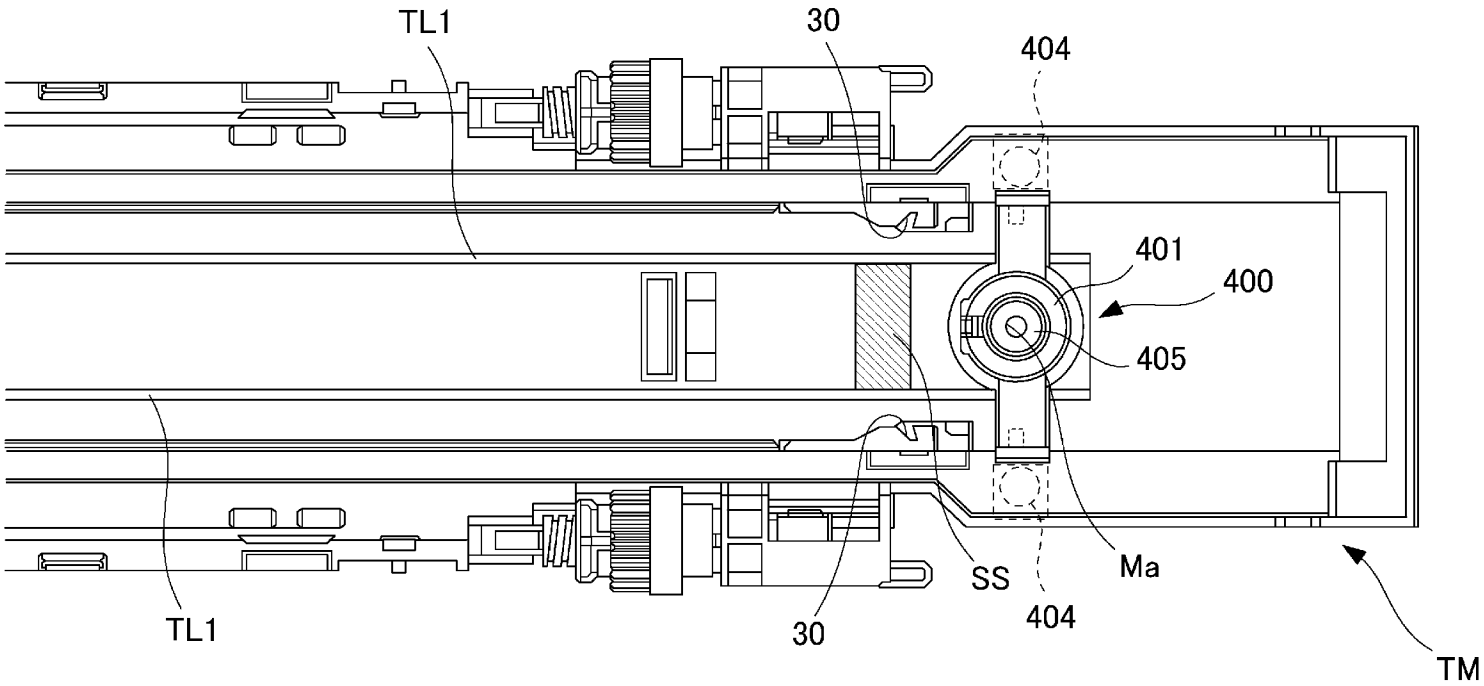
FIG. 7 is a plan view of a holding member configured to hold the container according to the embodiment.

As illustrated in FIG. 5, the supply device 70 (supply devices 70*a* to 70*d* have the same structure, and hence suffixes are omitted in the description hereinbelow) includes a containing portion 71, a conveying motor 90, and a screw 72 coupled to and driven by a gear train 73. The containing portion 71 is configured to contain toner therein, and serves as a supply route to which the toner supplied from the container T through intermediation of a connecting device 400 described later in FIG. 7 is supplied. The conveying motor 90 is rotated in synchronization with a device (not shown) configured to drive the developing device 100. With this, the toner supplied into the containing portion 71 is conveyed to the developing device 100 which is in close contact with and connected to the containing portion 71. In this way, toner is supplied to the developing device 100.

[Shutter]

Next, with reference to FIG. 7, FIG. 8, FIG. 9A, and FIG. 9B, the shutter 4 as a shutter member which is provided in the above-mentioned flange portion 21 of the container T so as to open and close the discharge port 21*a* will be described. FIG. 7 is a plan view of the holding member TM in a state in which the container T is not installed. FIG. is a plan view of the holding member TM in a state in which the shutter 4 is mounted in the state of FIG. 7. As illustrated in FIG. 7, two container slide rails TL1 are installed to a surface of the holding member TM onto which the container T is installed. On the surface of the holding member TM onto which the container T is installed, the two container slide rails TL1 are formed parallel to each other so that the container T is slid at the time of insertion into and removal from the apparatus main body 200A. Thus, the container T is mounted to the apparatus main body 200A by being moved from a near side to a far side of the image forming apparatus 200 while being guided by the two container slide rails TL1, and removed from the apparatus main body 200A by being moved to the opposite side. Further, as described below, on the surface of the holding member TM onto which the container T is installed, a cleaning member SS as a cleaning unit configured to clean off toner fouling the container T is provided.

Figure 8:
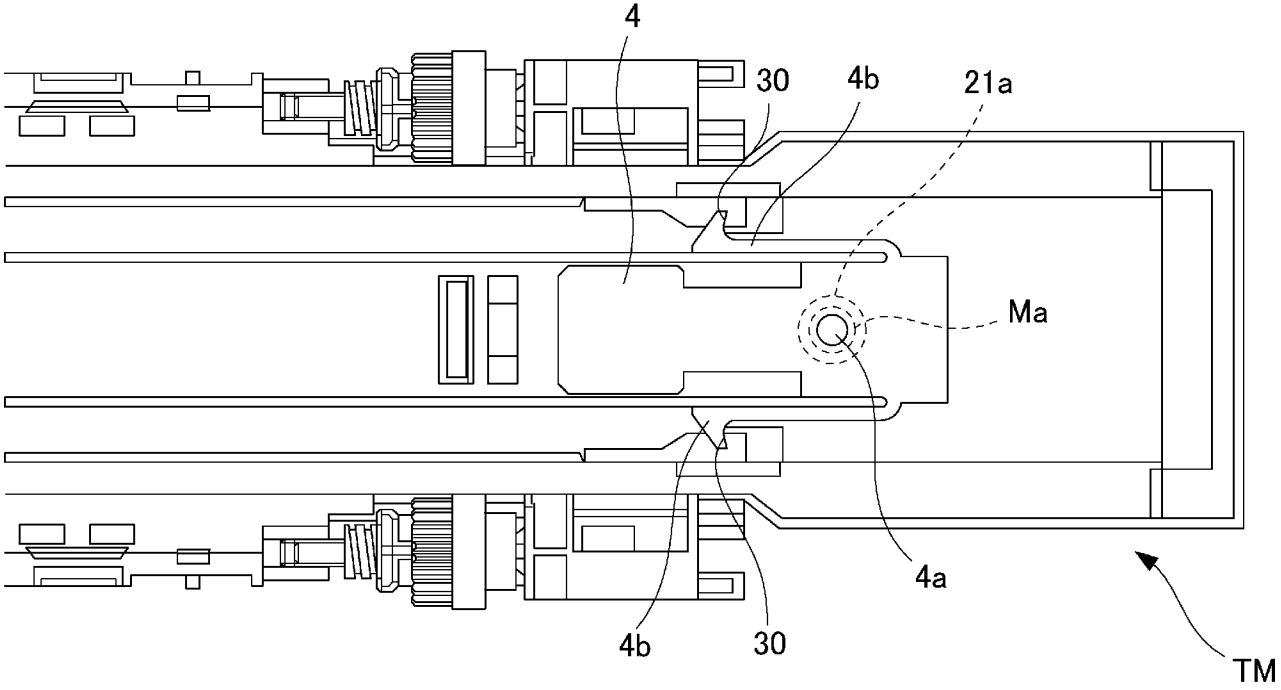
FIG. 8 is a plan view showing a state in which a shutter is mounted to the holding member of FIG. 7.
Figure 9A:
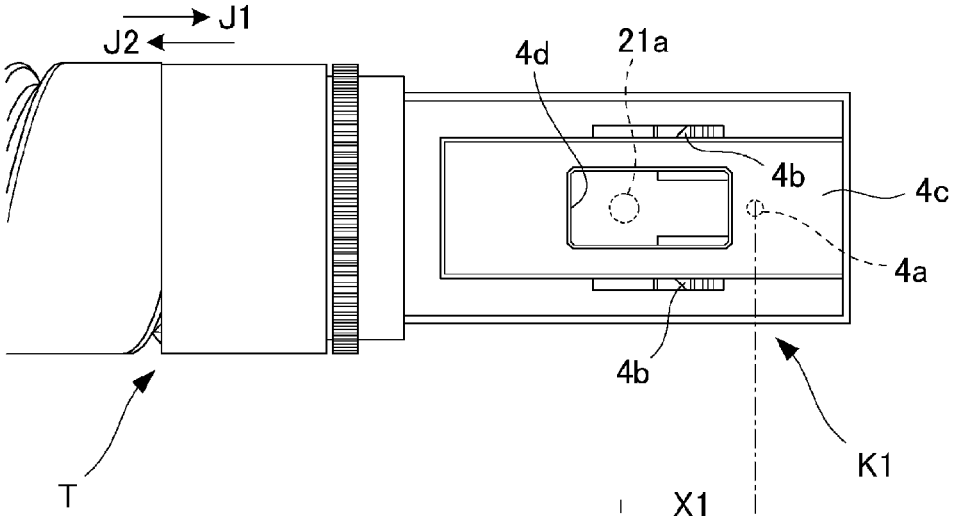
FIGS. 9A and 9B are plan views of a part of the container as viewed from the shutter, for illustrating movement of the shutter according to the embodiment.
Figure 9B:
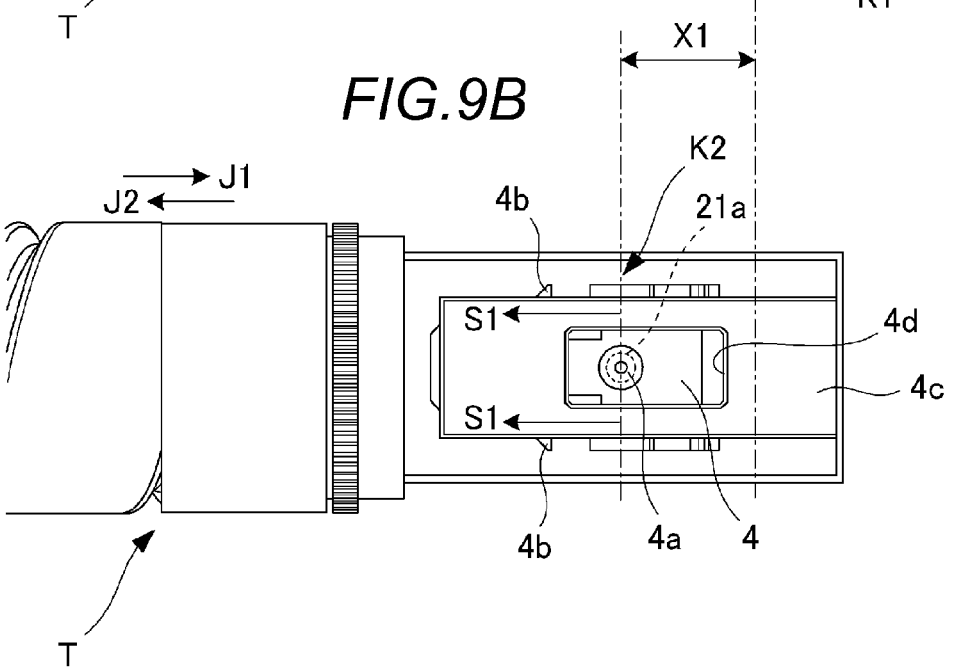

FIGS. 9A and 9B are each a plan view of a surface (rear surface) on the side of the holding member TM of the container T. As illustrated in FIG. 9A, the container T includes the shutter 4 having a communicating port (outlet) 4*a* configured to communicate with the discharge port 21*a* configured to discharge contained toner, and a holding portion 4*c* configured to slidably hold the shutter 4. The holding portion 4*c* is formed integrally with the surface on the side of the holding member TM of the flange portion 21 of the container T (refer to FIGS. 3A and 3B), and an opening portion 4*d* is formed therethrough so that the shutter 4 is partially exposed. Further, as illustrated in FIG. 8, at the time when the container T is mounted to or removed from the apparatus main body 200A, the discharge port 21*a* and the communicating port 4*a* of the shutter 4 are positioned between the two container slide rails TL1 (refer to FIG. 7).

A positional relationship between "the communicating port 4*a* formed in the shutter 4 of the container T" and "the discharge port 21*a* formed in the flange portion 21 of the container T" is set such that those ports are not overlapped with each other in an uninstalled state in which the container T is not installed to the apparatus main body 200A. In the embodiment, at the time when the container T is removed from the apparatus main body 200A, the shutter 4 closes the discharge port 21*a* by moving in a manner that the communicating port 4*a* aligned with the discharge port 21*a* is displaced therefrom. In other words, in the state in which the container T is not installed to the apparatus main body 200A, the discharge port 21*a* is sealed by the shutter 4 so that toner in the container T does not leak to the outside. At this time, as illustrated in FIG. 9A, the shutter 4 is located at a first position K1 prior to insertion of the container T into the apparatus main body 200A of the image forming apparatus 200.

In other words, at the time of removal of the container T from the apparatus main body 200A, a part of the shutter 4 is received in the holding portion 4*c* so that the side (opening portion side) of an opening portion Ma of the communicating port 4*a* is closed by the holding portion 4*c*. As described later, the shutter 4 slides in a manner that the communicating port 4*a* is closed by the holding portion 4*c* after connection between the opening portion Ma and the communicating port 4*a* is released. In other words, corresponding mechanisms are adjusted so that the connecting device 400 releases the connection as described later and the shutter 4 slides at such a timing.

When the container T is inserted into the apparatus main body 200A along the above-mentioned two container slide rails TL1, at a stage at which the container T is inserted up to a predetermined position, the shutter 4 reaches a setting position in the container T, which is located on the far side of the apparatus main body 200A. In FIGS. 9A and 9B, a direction indicated by an arrow J1 is an insertion direction (mount direction), and a direction indicated by an arrow J2 is a separating direction (removal direction). At this position, as illustrated in FIG. 8, locking portions 4*b* provided to the shutter 4 of the container T are engaged with stop portions 30 provided on the holding member TM. Further, when the container T is inserted further into the apparatus main body 200A, the locking portions 4*b* of the shutter 4 slide with respect to the flange portion 21 by an amount X1 in a direction indicated by the arrows S1. In this way, the state illustrated in FIG. 9B is achieved.

In this state, the discharge port 21*a* of the container T is positioned to be coaxial with the opening portion Ma of the connecting device 400 described below, which is provided in the holding member TM. At this time, the shutter 4 is located at a second position K2 in a state in which the container T is inserted in the apparatus main body 200A. In other words, the shutter 4 comes to a position at which the communicating port 4*a* is aligned with the discharge port 21*a* in a state in which the container T is mounted to the apparatus main body 200A.

[Connecting Device]

Figure 10:
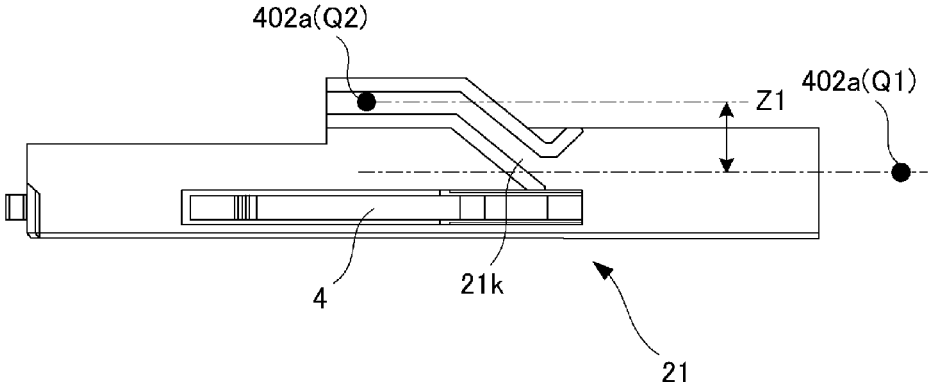
FIG. 10 is a partially enlarged view of the container, for specifically illustrating a mechanism configured to move up and down a connecting device according to the embodiment.
Figure 11A:
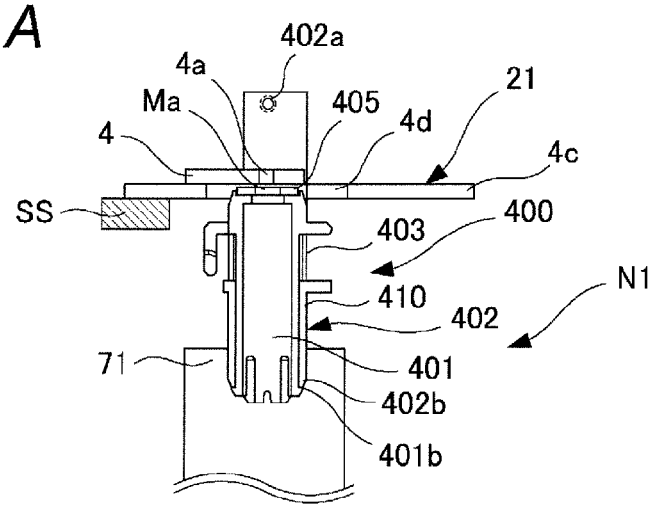
FIGS. 11A, 11B, and 11C are sectional views of a periphery of a connecting portion between the container and the connecting device, for sequentially illustrating an operation of removing the container according to the embodiment.
Figure 11B:
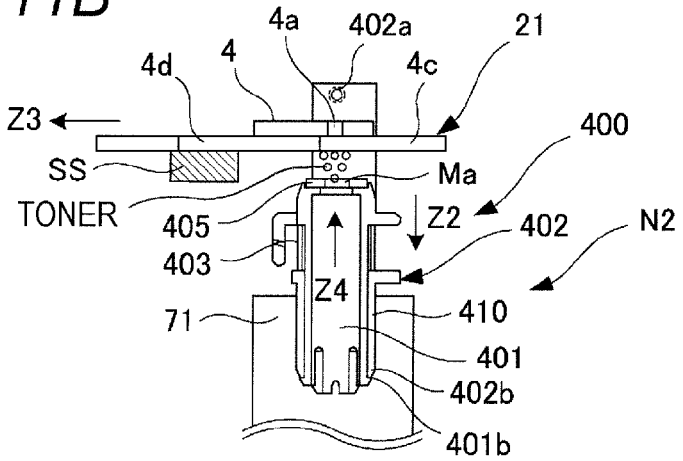
Figure 11C:
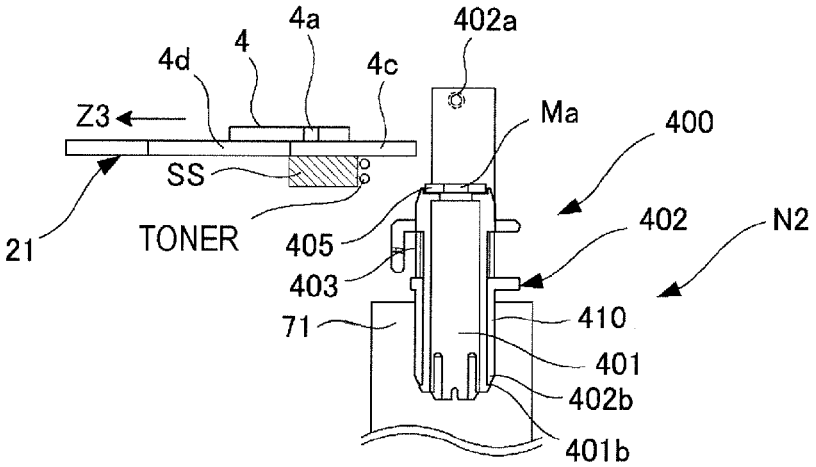

Next, with reference to FIG. 10 and FIGS. 11A, 11B and 11C, the connecting device 400 having the opening portion Ma as described above will be described. The connecting device 400 as a connecting unit is provided on the holding member TM of the apparatus main body 200A. Further, as illustrated in FIGS. 11A to 11C, the connecting device 400 includes a connecting pipe 401 as a connecting route member having a route which allows toner supplied to the opening portion Ma to pass the route. The connecting pipe 401 is interposed between the two container slide rails TL1 (refer to FIG. 7). The opening portion Ma is formed at one end portion of the connecting pipe 401, and an opening portion at another end portion of the connecting pipe 401 is disposed so as to enter the containing portion 71 of the supply device 70 and communicate with an inside of the containing portion 71.

Further, the opening portion Ma of the connecting pipe 401 is connected to the communicating port 4*a* of the shutter 4, which serves as an outlet, in the state in which the container T is mounted to the apparatus main body 200A. Then, in the state in which the communicating port 4*a* and the opening portion Ma are connected to each other, toner is supplied from the container T into the connecting pipe 401 through the communicating port 4*a* and the opening portion Ma. Meanwhile, the opening portion Ma of the connecting pipe 401 is released from connection to the communicating port 4*a* at the time when the container T is removed from the apparatus main body 200A.

Thus, the connecting pipe 401 is configured to be moved by a moving mechanism 402 as a moving unit in directions in which the connecting pipe 401 is moved toward and away from the container T. In other words, at the time when the container T is mounted to the apparatus main body 200A, the moving mechanism 402 moves the connecting pipe 401 in a direction in which the opening portion Ma of the connecting pipe 401 is moved toward the communicating port 4*a*. Meanwhile, at the time when the container T is removed from the apparatus main body 200A, the moving mechanism 402 moves the connecting pipe 401 in a direction in which the opening portion Ma is moved away from the communicating port 4*a*.

The moving mechanism 402 configured as described above includes a fitting cylindrical portion 410 which fits to and supports the connecting pipe 401, a projection 402*a* provided integrally with the fitting cylindrical portion 410, and a movement groove 21*k* which is formed in the flange portion 21 of the container T and with which the projection 402*a* is engageable. With this, as illustrated in FIG. 10, when the container T is inserted into the apparatus main body 200A, the projection 402*a* is engaged with the movement groove 21*k*, and moved by an amount Z1 along the movement groove 21*k* from a position Q1 to a position Q2. Further, when the container T is removed from the apparatus main body 200A, the projection

402*a* is moved along the movement groove 21*k* from the position Q2 to the position Q1. In other words, the projection 402*a* is moved (up and down) in a vertical direction in FIG. 10 and FIGS. 11A, 11B, and 11C. Note that, although not shown, another movement groove 21*k* having the same shape is formed on the opposite side so as to guide another projection 402*a*.

Further, in a state in which a part of the fitting cylindrical portion 410 which fits to and supports the connecting pipe 401 has entered the containing portion 71 of the supply device 70, an outer peripheral surface of the fitting cylindrical portion 410 and the containing portion 71 are movable relative to each other while sealing a gap therebetween. With this configuration, the connecting pipe 401 communicates with the containing portion 71, and is movable with respect to the containing portion 71 by the moving mechanism 402.

Next, an operation of the connecting device 400 will be described. First, the connecting pipe 401 is urged upward (in the direction toward the container T) in FIGS. 11A to 11C by a spacing spring 403. Further, the fitting cylindrical portion 410 is urged downward (in the direction away from the container T) in FIGS. 11A to 11C by movement springs 404 illustrated in FIG. 7. In addition, the above-mentioned opening portion Ma is formed in a connecting seal 405 embedded in a top of the connecting pipe 401. The connecting pipe 401 is pressurized by the spacing spring 403 and locked at a position at which a claw 401*b* abuts against a locking portion 402*b* of the fitting cylindrical portion 410. With this, the connecting pipe 401 is moved integrally with the fitting cylindrical portion 410.

At the time when the container T is mounted to the apparatus main body 200A, as described above, the movement grooves 21*k* and the projections 402*a* are engaged with each other. Thus, the connecting pipe 401 is moved toward the container T together with the fitting cylindrical portion 410. In this way, the state illustrated in FIG. 11A is achieved. At this time, the shutter 4 slides as described above to move to the second position K2 illustrated in FIG. 9B, and the shutter 4 and the connecting seal 405 are held in close contact with each other. With this, the communicating port 4*a* of the shutter 4 and the opening portion Ma are aligned and coaxial with each other. Further, in this state, the fitting cylindrical portion 410 which fits to and supports the connecting pipe 401 partially remains in the containing portion 71 of the supply device 70 (first position N1 of the connecting device 400).

At this stage, the discharge port 21*a*, the communicating port 4*a*, and the opening portion Ma are aligned coaxially with each other. In this state, by activating the motor 80, toner can be supplied from the container T into the containing portion 71 of the supply device 70 through intermediation of the connecting device 400. In other words, the toner can be discharged in a state in which the shutter 4 is located at the second position K2 and the connecting device 400 is located at the first position N1.

Meanwhile, when the container T starts to be moved away from the apparatus main body 200A, as illustrated in FIG. 11B, the flange portion 21 is moved integrally with the container T in a direction Z3 (removal direction). At this time, as described above, the projections 402*a* and the movement grooves 21*k* are engaged with each other. Thus, the connecting pipe 401 is moved in a direction Z2 (toward the side away from the container T) together with the fitting cylindrical portion 410 to reach a second position N2. At this time, the connecting pipe 401 is moved further into the containing portion 71, and hence pressure in the containing portion 71 becomes higher. As a result, the toner contained in the containing portion or toner adhering to an inner wall of the containing portion 71 spills out in a direction Z4 (toward the container T) through the opening portion Ma. At this time, the shutter 4 is partially received in the holding portion 4*c* so that the communicating port 4*a* on the side of the opening portion Ma is closed by the holding portion 4*c*. Meanwhile, the container T has been moved in the direction Z3 with respect to the connecting pipe 401. Thus, the toner that has been spilled out adheres to a part of a surface (lower surface) of the flange portion 21 of the container T, which faces the opening portion Ma of the connecting pipe 401.

[Cleaning Member]

Note that, in the embodiment, the cleaning member SS as the cleaning unit configured to clean off the toner adhering to the part of the container T, which faces the opening portion Ma of the connecting pipe 401 as described above, is provided. As described above, the cleaning member SS is provided on the surface of the holding member TM onto which the container T is installed. In particular, as illustrated in FIG. 7 and FIGS. 11A to 11C mentioned above, the cleaning member SS is interposed between the two container slide rails TL1 on a downstream side in the removal direction (direction Z3) of the container T with respect to the opening portion Ma of the connecting pipe 401. With this, at least along with movement of the container T at the time of removal of the container T from the apparatus main body 200A, the cleaning member SS rubs against and cleans the part of the container T, which faces the opening portion Ma.

In the following, the cleaning member SS will be described in detail. The cleaning member SS is formed of a pile material having thin flexible bristles of a pile length of approximately 2 to 3 mm, and is installed by being bonded between the two container slide rails TL1. An interval of, for example, approximately 15 mm is secured between the two container slide rails TL1, and a width of the cleaning member SS installed between the two container slide rails TL1 is also set substantially to approximately 15 mm. Further, a diameter of the opening portion Ma of the connecting device 400 is set to approximately 3 mm. In this way, an arrangement relationship in which the cleaning member SS sufficiently covers the toner spilled out along with the movement of the connecting pipe 401 as described above is established (the width substantially four times or more as large as the diameter of the opening portion Ma). Note that, the opening portion Ma and the cleaning member SS are arranged in line symmetry with respect to a straight line that extends to pass a center of the opening portion Ma in a direction parallel to the removal direction of the container T.

Further, the two container slide rails TL1 are set to be approximately 1 mm higher than an installation position of the cleaning member SS so that a bonded surface of the cleaning member SS is not peeled off by rubbing against the container T. With this, the cleaning member SS enters the container T by approximately 1 to 2 mm so as to perform cleaning in conjunction with insertion and removal of the container T.

As illustrated in FIG. 11B mentioned above, the toner that spills out at the time of removal of the container T from the apparatus main body 200A adheres mainly to the part of the surface (lower surface) of the flange portion 21 (specifically, the holding portion 4*c*) of the container T, which faces the opening portion Ma of the connecting pipe 401. In this state, when the container T is continuously moved further away, as illustrated in FIG. 11C, the cleaning member SS cleans off the toner adhering to the lower surface of the flange portion 21. The toner that has spilled off conically scatters. However, as described above, the width of the cleaning member SS is sufficiently larger than the diameter of the opening portion Ma. With this configuration, the cleaning member SS reliably cleans off the toner adhering to the lower surface of the flange portion 21.

Further, in the embodiment, the communicating port 4*a* of the shutter 4 is received into the holding portion 4*c* before the cleaning member SS passes thereby. Thus, the cleaning member SS does not clean off a periphery of the communicating port 4*a* of the shutter 4, and suppresses deterioration in toner collectability of the cleaning member SS. In other words, the communicating port 4*a* is a part of the toner supply route, and hence an amount of toner to adhere to the periphery of the communicating port 4*a* is larger than those at other parts in the container T. Thus, when the cleaning member SS cleans this part, the toner collectability of the cleaning member SS is shortly deteriorated. Meanwhile, in the embodiment, the cleaning member SS does not clean the part corresponding to the communicating port 4*a*, and hence the toner collectability can be suppressed from being shortly deteriorated. Further, in the state in which the container T is removed from the apparatus main body 200A, the communicating port 4*a* is received in the holding portion 4*c*. Thus, a user is prevented from touching the periphery of the communicating port 4*a*.

After that, the connecting pipe 401 of the connecting device 400 is maintained at the first position N1 at the time of mounting the container T, and at the second position N2 at the time of removing (taking out) the container T. In this way, the connecting pipe 401 adapts to replacement of the container T. Note that, at the time of removing the mounted container T from the apparatus main body 200A, as described above, first, the opening portion Ma of the connecting pipe 401 is moved away from the communicating port 4*a* of the shutter 4, and then the communicating port 4*a* is received into the holding portion 4*c*. After that, the surface of the holding portion 4*c* to which toner adheres is cleaned by the cleaning member SS.

As described above, after the connection between the communicating port 4*a* and the opening portion Ma is released, the cleaning member SS cleans the part of the container T, which faces the opening portion Ma. With this configuration, it is possible to avoid a situation where the user touches the toner adhering to the container T at the time of removal from the apparatus main body 200A. In particular, in the embodiment, at the time of the removal operation of the container T, the cleaning member SS rubs against and cleans the part of the container T. Thus, adhering toner can be cleaned off by a simple configuration.

Further, the cleaning member SS does not directly clean the periphery of the communicating port 4*a* as a toner route, but cleans only the toner that has spilled out. Thus, a trace amount of toner is cleaned off, and hence the container T can be continuously cleaned without deterioration of the toner collectability. As a result, at the time of being handled by the user, a toner container can be provided under a toner-foul free state, and this effect is not lost even when the toner container is more frequently replaced.

Note that, in the description hereinabove, cleaning is performed by rubbing the cleaning member SS against the part of the container T in conjunction with the removal operation of the container T, but the mechanism of the cleaning is not limited thereto. For example, the part of the container may be cleaned by moving the cleaning member in conjunction with the removal operation of the container.

Further, the present invention is not limited to the configurations as described hereinabove, and is applicable to any other configurations as long as developer can be supplied from containers each containing developer into supply devices or developing devices. Still further, toner is supplied from the container in the description hereinabove, but the developer to be supplied therefrom may contain carrier in addition to the toner, or may contain other materials such as an extraneous additive.

According to the embodiment of the present invention, after the connection between the outlet and the opening portion is released, the cleaning unit cleans the part of the container, which faces the opening portion. With this configuration, it is possible to avoid a situation where the user touches the developer adhering to the container at the time of removal from the apparatus main body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-038533, filed Feb. 28, 2014, which is hereby incorporated by reference herein in its entirety.

What is claimed is:

1. An image forming apparatus, comprising:

an apparatus main body;

a container which is removably mountable to the apparatus main body and has an outlet configured to discharge developer contained in the container;

a connecting route member having an opening portion configured to be separated from and connected to the outlet, and a route through which the developer supplied to the opening portion passes;

a moving unit configured to move the connecting route member in a direction in which the opening portion is moved toward the outlet at a time when the container is mounted to the apparatus main body, and in a direction in which the opening portion is moved away from the outlet at a time when the container is removed from the apparatus main body; and a cleaning unit configured to clean a part of the container, which faces the opening portion, after connection between the outlet and the opening portion is released.

2. An image forming apparatus according to claim 1, wherein the container comprises:

a shutter member having a communicating port as the outlet configured to communicate with a discharge port configured to discharge the developer contained in the container; and a holding portion configured to slidably hold the shutter member, and wherein the shutter member is positioned so that the communicating port is aligned with the discharge port in the state in which the container is mounted to the apparatus main body, and the shutter member is moved so that the communicating port is displaced from a position in which the communicating port is aligned with the discharge port at the time when the container is removed from the apparatus main body, to close the discharge port.

3. An image forming apparatus according to claim 2, wherein a part of the shutter member is contained in the holding portion at the time when the container is removed from the apparatus main body so that a side of the opening portion of the communicating port is closed by the holding portion, and wherein a part of the communicating port on the side of the opening portion is closed by the holding portion before the communicating port passes a cleaning position by the cleaning unit as the container is removed from the apparatus main body.

4. An image forming apparatus according to claim 3, wherein the shutter member is slid so that the communicating port is closed by the holding portion after the connection between the opening portion and the communicating port is released.

5. An image forming apparatus according to claim 1, further comprising:

a developing device configured to develop, with the developer, an electrostatic latent image formed on an image bearing member; and a supply device having a supply route to which the developer supplied from the container through the connecting unit is supplied, and being configured to supply the developer to the developing device, wherein the connecting route member communicates with the supply route, and is moved with respect to the supply route by the moving unit.

6. An image forming apparatus, comprising:

an apparatus main body;

a container which is removably mountable to the apparatus main body and has an outlet configured to discharge developer contained in the container;

a connecting route member having an opening portion configured to be separated from and connected to the outlet, and a route through which the developer supplied to the opening portion passes;

a moving unit configured to move the connecting route member in a direction in which the opening portion is moved toward the outlet at a time when the container is mounted to the apparatus main body, and in a direction in which the opening portion is moved away from the outlet at a time when the container is removed from the apparatus main body; and a cleaning unit provided in the apparatus main body and configured to rub against and clean a part of the container, which faces the opening portion, at least along with movement of the container at the time when the container is removed from the apparatus main body.

7. An image forming apparatus, comprising:

an apparatus main body;

a toner cartridge which is removably mountable to the apparatus main body and has a containing portion configured to contain toner, an outlet configured to discharge the toner contained in the containing portion, and a shutter configured to open and close the outlet;

a connecting route member movably provided in the apparatus main body so as to be connected to and separated from the toner cartridge and configured to form a route through which the toner discharged from the outlet passes;

a receiving portion configured to receive the toner which has passed the connecting route member, wherein the connecting route member is configured to enter an interior of the receiving portion when the connecting route member is separated from the toner cartridge; and a cleaning member provided in the apparatus main body and in a position downstream of a connecting position, in which the connecting route member and the toner cartridge connect with each other, in a removal direction of the toner cartridge and configured to clean a periphery of an area, at which the toner cartridge connects with the connecting route member, on the toner cartridge in association with a removal operation of the toner cartridge.

8. An image forming apparatus according to claim 7, wherein the shutter is provided with a communicating port communicatable with the outlet, and the connecting route member is configured to be connected to and separated from the shutter so as to communicate with the outlet through the communicating port, and wherein the toner cartridge includes a shutter containing portion configured to contain the shutter in association with the removal operation of the toner cartridge from the apparatus main body, and the shutter containing portion contains the shutter so as to cover at least the communicating port provided in the shutter, and the communicating port is contained in the shutter containing portion before the communicating port passes a position opposed to the cleaning member in association with the removal operation of the toner cartridge.

* * * * *